United States Patent [19]

Kuse et al.

[11] Patent Number: 4,613,562

[45] Date of Patent: Sep. 23, 1986

[54] PROCESS OF REPLENISHING COLOR DEVELOPING SOLUTION WITH REPLENISHER COMPOSITIONS

[75] Inventors: Satoru Kuse; Shigeharu Koboshi; Kazuhiro Kobayashi, all of Hino, Japan

[73] Assignee: Konishiroku Photo Industry Co., Ltd., Tokyo, Japan

[21] Appl. No.: 721,567

[22] Filed: Apr. 10, 1985

[30] Foreign Application Priority Data

Apr. 16, 1984 [JP] Japan ..... 59-77146

[51] Int. Cl.[4] ..... G03C 5/30; G03C 7/30

[52] U.S. Cl. ..... 430/450; 430/399

[58] Field of Search ..... 430/399, 450

[56] References Cited

U.S. PATENT DOCUMENTS 3,647,462 3/1972 Surash et al. ..... 430/399

4,245,034 1/1981 Libicky et al. ..... 430/399

4,297,437 10/1981 Kaneko et al. ..... 430/399

4,414,307 11/1983 Kapecki et al. ..... 430/467

*Primary Examiner*—Mary F. Downey

*Attorney, Agent, or Firm*—Frishauf, Holtz, Goodman & Woodward

[57] ABSTRACT

Disclosed is a process for replenishing a color developing solution by using a replenisher composition comprising at least two separate solutions of a solution dissolving an alkaline substance and a solution to which there has been added an alkali-cleavable water-soluble salt of a poorly soluble alcohol.

According to the process of the present invention, a poorly soluble alcohol can be dissolved uniformly, easily and within a short time in the replenishment of a color developing solution. The present process can realize a compact AR system without any necessity of a mixing device and so on.

9 Claims, 3 Drawing Figures

PROCESS OF REPLENISHING COLOR DEVELOPING SOLUTION WITH REPLENISHER COMPOSITIONS

BACKGROUND OF THE INVENTION

The present invention relates to a process of replenishing a color developing solution for a light-sensitive silver halide color photographic material, more specifically to a process for replenishing a color developing solution with replenisher compositions which process can dissolve a poorly soluble alcohol uniformly, easily and in a short time, and also suitable for the AR system (which will be explained hereinafter).

A color developing solution which is used for processing a light-sensitive silver halide color photographic material usually contains such developer components as represented by a p-phenylenediamine derivative or a salt thereof as a color developing agent; a carbonate, a borate or a phosphate as an alkaline agent; a sulfite or a hydroxylamine salt as a preservative; and so on. It further contains, as occasion demands, a poorly soluble alcohol as a development accelerator, for example, benzyl alcohol or the like.

When such a color developing solution is used continuously and its use is over a long period of time, the main component thereof is consumed and an added component (additive) is dissolved out of a light-sensitive material to be processed. As the result, the activity of the color developing solution is lost and the obtained image properties are subject to deterioration.

Thus, for the purpose of replenishing the developing components which have been lost by the above-mentioned continuous processing and of diluting the additive components which have been dissolved out of the light-sensitive material, there has been taken a procedure in which a color developing replenisher is prepared and supplemented in necessary portions to the above-mentioned color developing solution.

Recently, on account of economy and of the social demand to minimize any pollutive component which is caused by the waste developing solution to be discharged during the developing process, there is a tendency that the replenisher for a color developing solution be thickened or concentrated and the amount thereof reduced. In order to save labor for the mixing and dissolving operations of chemical agents for a developing solution or to concentrate and minimize the replenishing amount, the necessity is expanding for a concentrated supplemental developing solution capable of easy preparation only by diluting with water.

However, a poorly soluble alcohol, e.g., benzyl alcohol etc., to be used as a development accelerator has extremely poor solubility in water or a color developing solution, it has required a fairly long time for the replenisher composition to dissolve thoroughly, and vigorous stirring and heating have frequently been required.

In cases where the dissolution of such poorly soluble alcohol is insufficient, there is observed phenomena of oil-drops being formed in the developing solution (oil-out) and floating at the surface thereof.

This causes smears in a color developer tank, a replenisher tank or a mixing tank of an automatic processing machine which is used for the processing, and further causes a change in a practical composition of a developing solution to exert an adverse effect upon photographical processing performance, which has been problematic.

For the purpose of improving the above drawbacks, there are proposed methods of preparing an aqueous dispersion by using glycols such as ethylene glycol as described in the specification of U.S. Pat. No. 3,574,615 and so on or by using celluloses such as hydroxyethyl cellulose as described in the specification of U.S. Pat. No. 3,615,496 and so on to disperse above-mentioned poorly soluble alcohol.

However, in cases where a glycol mentioned above is used, 10 g or more of the same is required per 1 lit. of the color developing solution, which results in remarkable increase of B.O.D. (Biochemical Oxygen Demand) or C.O.D. (Chemical Oxygen Demand) in the color developing solution. This is not only undesirable in view of the prevention of pollution but also disadvantageous economically.

On the other hand, in cases where a cellulose is used as has been done conventionally, it has a property capable of dispersing and solubilizing the poorly soluble alcohol with a relatively small amount thereof. However, a large amount of water is necessary to obtain a uniform replenisher composition leading to a large volume of a replenisher composition. Further, since a small amount of water cannot provide any uniform replenisher composition, there is a drawback in that a part of such non-uniform replenisher composition cannot be taken out for replenishment.

There has recently been adopted an AR system (Automatic Replenishing System) in which various parts of processing agents and a dilution kit are connected with each other and the solutions are automatically diluted and mixed with water followed by replenishing a processing tank of an automatic processing machine, for the purposes of simplifying the operation for dissolving the processing agents and of labor-saving.

However, since a poorly soluble alcohol, such as benzyl alcohol etc. is extremely inferior in solubility, a mixing room and a mixing device are always provided with said AR system. So the AR system carries a problem that it fails to be compact as a device.

Thus, an object of the present invention is primarily to provide a process for replenishing a developing solution with a replenisher composition, which process is capable of dissolving a poorly soluble alcohol uniformly, easily and within a short time in the replenishment of the color developing solution, secondarily to provide a process for replenishing a color developing solution with a replenisher composition, wherein each part has an excellent solubility to realize a compact AR system without any necessity of a mixing device and so on.

SUMMARY OF THE INVENTION

The objects of the present invention defined above may be achieved by use of a process of replenishing a color developing solution with a replenisher composition, wherein at least two kinds of separate solutions for a color developing solution, i.e., Solution (A) comprising an alkaline substance and Solution (B) comprising a water soluble salt of a poorly soluble alcohol which may be cleaved by an alkali, are supplemented.

DESCRIPTION OF PREFERRED EMBODIMENT

Figure 1:
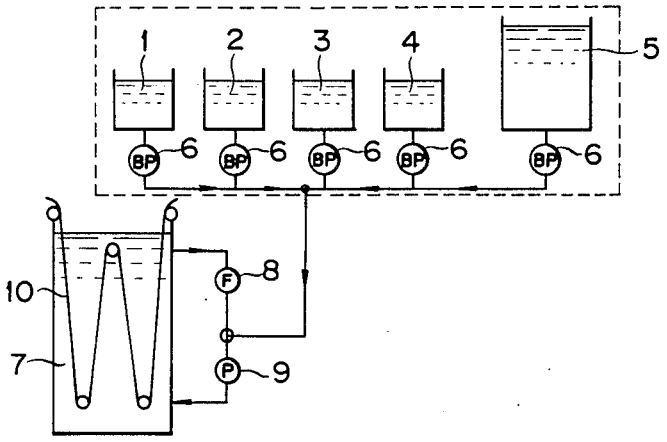
FIG. 1 is a schematic one showing the automatic developing system to be used in the replenishing process of the present invention.

The present invention will be explained further in detail as follows:

In the first place, the alkaline substance for the replenisher composition to be used in the present process of replenishing a color developing solution with a replenisher composition (hereinafter simply referred to as the replenishing process of the present invention), which is an alkaline compound usually used as a component for the developing solution for photography, may include, a carbonate (e.g., potassium carbonate, sodium carbonate, etc.), a borate (e.g., borax, sodium borate, potassium borate, etc.), a phosphate (e.g., sodium phosphate, potassium phosphate, etc.), an organic amine (e.g., ethylenediamine, triethanolamine, polyethyleneimine, trimethylamine, etc.), a silicate (e.g., sodium silicate etc.), sodium hydroxide and potassium hydroxide.

Solution (A) of the present invention comprising an alkaline substance dissolved therein is used as an alkaline solution of pH 7.5 or more, preferably of pH 9 or more, especially of pH 10.5 or more.

Solution (A) of the present invention comprising an alkaline substance dissolved therein may contain an organic solvent (e.g., ethylene glycol, diethylene glycol, hexylene glycol, etc.), a chelating agent (e.g., nitridotriacetic acid, diethylenetriaminepentacetic acid, 1-hydroxyethylidene-1,1-diphosphonic acid, 2-propanol-1,3-diamine-tetracetatic acid, etc.), a preservative (e.g., potassium sulfite, sodium metahydrogensulfite, etc.), an alkali halide (e.g., sodium bromide, potassium chloride, potassium iodide, etc.).

Especially when a chelating agent is incorporated, it will exhibit an effect to prevent the formation of sludge, which is liable to occur in Solution (A), and this may be mentioned as one of the preferred embodiments for the present invention.

Next, to describe the water soluble salt of a poorly soluble alcohol which may be cleaved by an alkali, the water soluble salt of a poorly soluble alcohol may be represented by the following General Formula (I): General Formula (I)

$$A—B$$

wherein A represents a residue of a poorly soluble alcohol, capable of releasing said poorly soluble alcohol when the salt is cleaved under an alkaline condition, may possibly liberate the poorly soluble alcohol. B represents a water soluble group.

The above-mentioned poorly soluble alcohol which is released by cleavage under alkaline conditions includes, for example, benzyl alcohol, o-hydroxybenzyl alcohol, cyclohexanol, t-butyl alcohol, 2-phenoxyethanol, phenylethyl alcohol, etc.

Benzyl alcohol, which is especially excellent in the acceleration of development among the above-mentioned poorly soluble alcohols, is most preferably used in the present invention.

The water soluble group represented by B in said General Formula is a group which can form a carbonate, a sulfite, a sulfate, a phosphate, a borate, etc., when it is cleaved by an alkali.

In the present invention, a water soluble salt of a poorly soluble alcohol represented by said General Formula (I) may preferably be represented by the following General Formula (II): General Formula (II)

$$R—(CH_2)_n—O—X—O—M$$

wherein R represents an alkyl group having 1 to 10 carabon atoms or an aryl group; X represents a —CO— group, an —SO— group, an $—SO_2—$ group, a $—PO_2—$ group or a —BO— group; M represents an alkali metal group such as potassium, sodium, lithium, etc. or an ammonium group; n is an integer of 1 to 4.

Furthermore, in the present invention, the compound represented by said General Formula (II) may more preferably be represented by the following General Formula (III) General Formula (III)

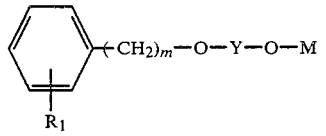

wherein $R_1$ represents a hydrogen atom or an alkyl group having 1 to 4 carbon atoms; Y represents a —CO— group or an —SO— group; M has the same meaning as defined in the General Formula (II); m is an integer of 1 to 3.

Typical examples of the compounds which may be represented by said General Formula (I) are as follows: (Exemplary Compounds)

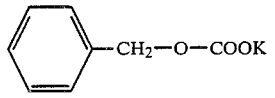

(1)

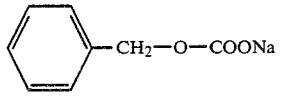

(2)

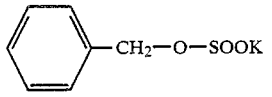

(3)

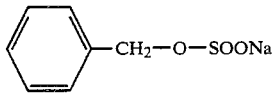

(4)

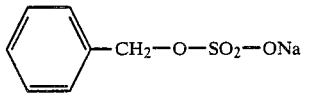

(5)

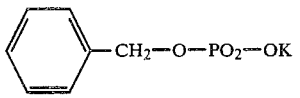

(6)

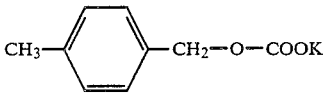

(7)

$$C_6H_{13}—CH_2—O—COON_a \quad (8)$$

The water soluble salts which may be cleaved by an alkali as exemplified above may easily be prepared according to the synthesis method described in U.S. Pat. No. 4,414,307.

Solution (B) used in the present invention, which contains the water soluble salt of a poorly soluble alcohol, can exhibit good effect of the invention particularly when it is used as a solution having such a concentration that can provide a concentration of the poorly soluble alcohol, released after hydrolysis of the salt under alkaline conditions, of 40 g/liter or more. When the above-mentioned Solution (B) is more preferably used as a solution as can provide a concentration of the released poorly soluble alcohol of 80 g/liter or more, much better effect of the present invention can be obtained.

Solution (B) of the present invention comprising the water soluble salt of a poorly soluble alcohol may include an organic solvent (e.g., ethylene glycol, diethylene glycol, polyethylene glycol, hexylene glycol, etc.), a buffer (e.g., borate, phosphate, phthalate, glycine, acetate, carbonate, etc.), a chelating agent (e.g., 1-hydroxyethylidene-1,1-diphosphonic acid, diethylenetriaminepentacetic acid, etc.) and it is preferred to include especially above-mentioned organic solvent(s) , since it will exhibit an effect of further improving the solubility of Solution (B) of the present invention.

In the present invention the storability of a poorly soluble alcohol is surprisingly improved when at least two parts of solutions are used--a water soluble salt of a poorly soluble alcohol as a part of thick solution and a separate alkaline solution as another part of solution--and there is another effect of preventing oil-out. Furthermore, the addition of an organic phosphonate chelating agent (e.g., 1-hydroxyethylidene-1,1-diphosphonic acid etc.) or an aminopolycarboxylic acid chelating agent (e.g., diethylenetriaminepentaacetic acid, 2-propanol-1,3-diaminotetraacetic acid, nitrilotriacetic acid hydroxyethyliminodiacetic acid, etc.) to Solution (A) of the present invention comprising an alkaline substance dissolved therein, it will not only prevent the formation of sludge in Solution (A) but also effect extremely good mixing of Solution (A) with Solution (B) of the present invention comprising the water soluble salt of a poorly soluble alcohol.

The pH value of 9 or more of Solution (B) is not preferred since a pH of 9 or more cases hydrolysis of the water soluble salt of a poorly soluble alcohol to oil out the poorly soluble alcohol. Further, a pH of lower than 4 makes the above-mentioned water soluble salt to be unstable or even to be decomposed. Therefore, it is preferable to store Solution (B) under a condition of pH 4–9.

According to the replenishing process of the present invention, a more favorable effect may be obtained by replenishing a color developing solution with at least two kinds of said separate replenisher compositions for the color developing solution, i.e., Solution (A) and Solution (B), with substantially no mixing thereof prior to replenishment.

While the above-mentioned "replenishment of a color developing solution with substantially no mixing of replenisher compositions" will be explained specifically by way of FIG. 1, it means a process where any forced or intentional mixing by using, for example, a mixing device is not carried out. Even contact of Solutions (A) and (B) within a replenishing piping or tube may be included in the above-mentioned case of "substantially no mixing".

FIG. 1 is a constitutional view of an apparatus showing an example of an automatic developing system to be used in the replenishing process of the present invention and the part surrounded by the dotted line is the AR system, wherein 1 is a replenisher tank supplied with said Solution (A); 2 is a replenisher tank filled with said Solution (B), 3 is a replenisher tank filled with Solution (C), which although described in the below-mentioned Examples, is, for example, a solution comprising a color developing agent. 4 is a replenisher tank supplied with Solution (D), which although described in the below-mentioned Examples, is, for example, a solution of a preservative (such as hydroxylamine etc.) which is prohibited to be mixed with the color developing agent. 5 is a water tank; 6 is a bellows pump. 7 is a developer tank of the automatic processing machine; 8 is a filter; 9 is a circulating pump; 10 is a light-sensitive material to be processed.

While the replenishing process in the automatic developing apparatus (FIG. 3) as constructed in such a manner as mentioned above will be explained in detail in the Examples described below, the developer tank 7 is replenished in the order of water (Tank 5)—Solution (A) (Tank 1)—Solution (B) (Tank 2)—Solution (C) (Tank 3)—Solution (D) (Tank 4), and for the purpose of attaining further completely substantially no mixing of of Solution (A) and Solution (B) of the present invention, the replenishment of the developer tank 7 is carried out in the order of Solution (A) (Tank 1)—water (Tank 5)—Solution (B) (Tank 2)—Solution (C) (Tank 3)—Solution (D) (Tank 4).

As can be understood from the above-mentioned orders of feeding solutions, Solution (A) and Solution (B) are placed separately in different tanks, and are transmitted or fed into Tank 7 at slightly different times. Therefore the developer tank 7 is replenished with these solutions with substantially no mixing thereof. Thus, the effect of the present invention can be obtained at least by separating Solution (A) and Solution (B).

According to the present invention, each of Solution (A) in which the alkaline substance of the invention has been dissolved and Solution (B) in which the poorly soluble alcohol of the invention has been dissolved may directly be supplemented to the developer tank in an automatic developing apparatus, or may be supplemented to the tank after they are mixed with each other while they are thick or concentrated or after they are diluted and mixed.

However, the developer tank of an automatic developing apparatus may preferably be replenished directly with the above-mentioned Solutions (A) and (B) as well as other replenisher compositions in order to enable adoption of the AR system where no mixing device is needed. The developer tank referred to in the present invention is constituted not only by a tank but also by such an appended circulating system as a filter part, a circulating pump, and a piping for circulation, etc.

The order of adding Solution (A), Solution (B) and other replenisher compositions is not specifically designated. Either of Solution (A) or Solution (B) may be added at the beginning or the end of the addition, or Solutions (A) and (B) may be added simultaneously.

Figure 2:
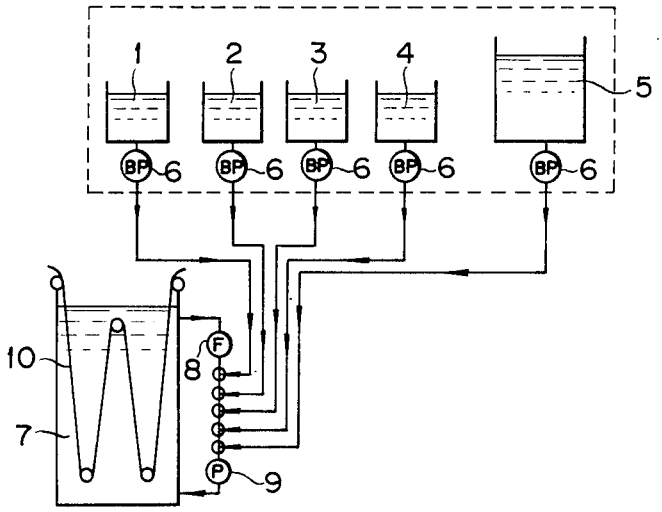
FIG. 2 is a schematic one of another type of the same system as that of FIG. 1.

FIG. 2 shows schematically another Example of an automatic processing apparatus to which the replenishing process of the present invention is applied.

In the figure, all the symbols and numerals are the same as in FIG. 1. When such an apparatus as shown in the Figure, the order of the additions of the replenisher compositions as mentioned above may be controlled in any optional manner.

It has already been known that the alkali-cleavable water-soluble salt of a poorly soluble alcohol is employed for the preparation of a developing solution, as disclosed in Japanese Provisional Patent Publn. No. 156934/1983.

The present invention has improved further the technology disclosed in the publication mentioned above. It has been found that, when the solid alkali-cleavable water-soluble salt of a poorly soluble alcohol is employed as a replenisher composition in the form of a thick solution, the poorly soluble alcohol may be dissolved in a developing solution uniformly and in an extremely short time without any generation of oil drops and hence the replenisher composition according to the present invention is extremely excellent as a replenisher composition for the AR system.

The replenisher composition for a color developing solution to be used in the present invention may inlude various additives, which may be used for an ordinary developing solution, for example, potassium bromide, sodium chloride, citrazinic acid (development controller), hydroxylamine, sulfite (a preservative), etc.; it may optionally include various defoaming agents, various surface active agents and an organic solvent, such as ethylene glycol, diethylene glycol, methanol, dimethylformamide, dimethylsulfoxide and the like.

The replenisher composition for a color developing solution to be used in the present invention may include, as occasion demands, an anti-oxidant, such as hydroxyurine, tetronic acid, tetronimide, 2-anilinoethanol, dihydroxyacetone, aromatic secondary alcohol, hydroxam acid, pentose, hexose or pyrogallolle-1,3-dimethylether, etc.

Furthermore, in the replenisher composition for a color developing solution relating to the present invention, various chelating agents may be jointly used as a sequestering agent. Said chelating agents include an aminopolycarboxylic acid such as ethylenediaminetetracetic acid, diethylenetriaminepentacetic acid, etc., an organic phosphonic acid such as 1-hydroxyethylidene-1,1-diphosphonic acid etc., and an aminopolyphosphonic acid such as aminotri(methylenephosphonic acid), ethylenediaminetetraphosphonic acid, etc., an oxycarboxylic acid such as citric acid, gluconic acid, etc., a phosphonocarboxylic acid 2-phosphonobutane-1,2,4-tricarboxylic acid, a polyphosphoric acid such as tripolyphosphoric acid, hexametaphosphoric acid.

While p-phenylene series color developing agent is used as a replenisher composition for color developing solution relating to the present invention, a compound represented by the following General Formula (IV) is preferred as a color developing agent. General Formula (IV)

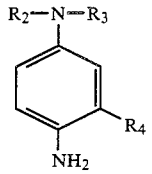

wherein, $R_4$ represents a hydrogen atom, a halogen atom or an alkyl group, which alkyl group represents a straight-chain or branched-chain alkyl group having 1 to 5 carbon atoms and may further be substituted by a substituent. $R_2$ and $R_3$ each represent a hydrogen atom, a substituted or unsubstituted alkyl group or a substituted or unsubstituted aryl group; and as for the alkyl group, such an alkyl group further substituted by an aryl group is preferable. And at least one of $R_2$ and $R_3$ is an alkyl group which has been substituted by a water soluble group such as a hydroxyl group, a carboxyl group, a sulfonic acid group, an amino group, a sulfonamide group, etc., or a $-((CH_2)_pO)_q-R_5$ group. This alkyl group may further be substituted by a substituent.

$R_5$ represents a hydrogen atom or an alkyl group, which alkyl group represents a straight-chain or branched-chain alkyl group having 1 to 5 carbon atoms; p and q are integers of 1 to 5.

Next, typical examples of the compound represented by said General Formula (IV) are given below, however, such compounds are not restricted to them. (Exemplary compounds)

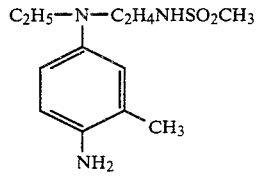

(IV-1)

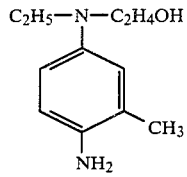

(IV-2)

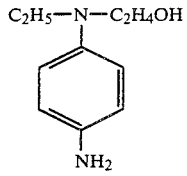

(IV-3)

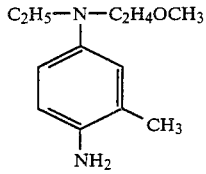

(IV-4)

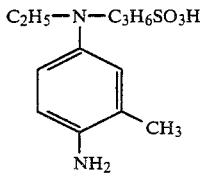

(IV-5)

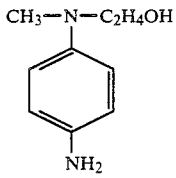

(IV-6)

-continued (IV-7)

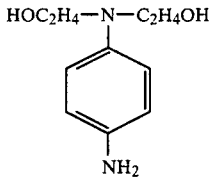

(IV-8)

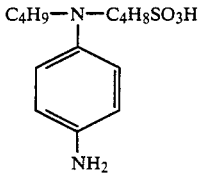

(IV-9)

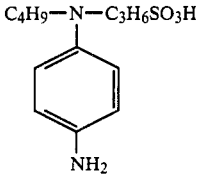

(IV-10)

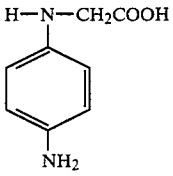

(IV-11)

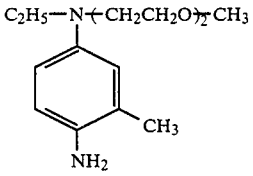

(IV-12)

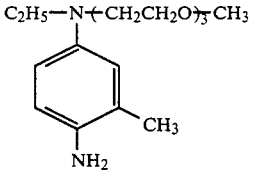

(IV-13)

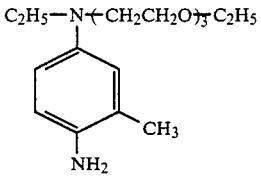

(IV-14)

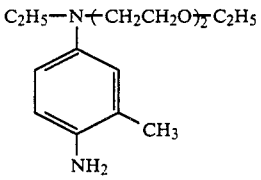

-continued (IV-15)

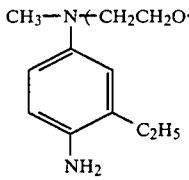

These p-phenylenediamine derivatives represented by the General Formula (IV) may be used as a salt of an organic acid or an inorganic acid, which may include a hydrochloride, a sulfate, a phosphate, a p-toluensulfonate, a sulfite, an oxalate, a benzenesulfonate, etc.

In the present invention, the effect of the object of the present invention may be especially remarkably exhibited when $R_2$ and/or $R_3$ is a $-((CH_2)_pO)_qR_5$ (wherein p, q and $R_5$ have the same meanings as defined above) among other p-phenylenediamine derivatives represented by said General Formula (IV).

The color developing agent represented by said General Formula (IV) may be added to and included in a light-sensitive material.

Light-sensitive silver halide color photographic materials being processed by means of the replenishing process of the present invention may include color printing paper, color negative film, color reversal film, color reversal printing paper, etc.

The replenishing process of the present invention will be explained concretely by way of Examples given below:

EXAMPLE 1

The following Solutions (A) to (D) were prepared as replenisher compositions for a developing solution for color printing paper.

| | |
|---|---|
| Solution (A) | |
| Potassium carbonate | 312.5 g |
| 1-hydroxyethyliden-1,1-diphosfonic acid (60% solution) | 12.5 ml |
| Potassium sulfite (50% solution) | 62.5 ml |
| Potassium hydroxide | 37.5 g |
| Water | to make up 1 liter |
| Solution (B-1) | |
| Benzyl alcohol | 250 g |
| Ethylene glycol | 500 ml |
| 4,4'-diaminostilbenedisulfonic acid (fluorescent brightening agent) | 50 ml |
| Water | to make up 1 liter |
| Solution (C) | |
| Sulfate of the Exemplary Compound (IV-1) | 235 g |
| Potassium sulfite (50% solution) | 30 ml |
| Water | to make up 1 liter |
| Solution (D) | |
| Hydroxylamine sulfate | 160 g |
| Lithium chloride | 80 g |
| Water | to make up 1 liter |

Figure 3:
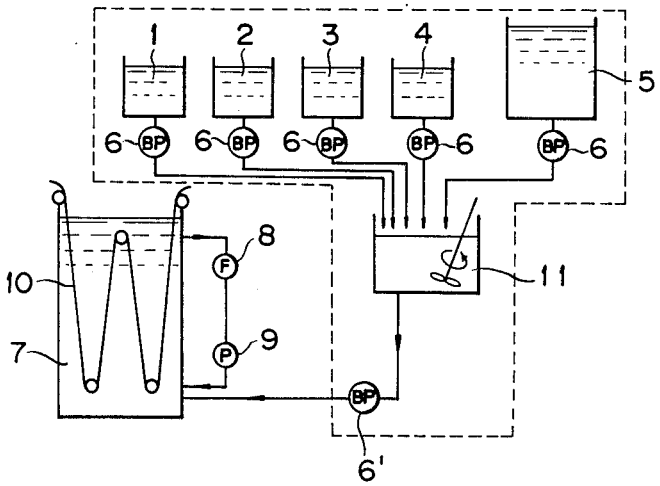
FIG. 3 is a schematic one of an automatic developing system according to the present invention.

Each solution thus prepared was put into the mixing device 11 of the automatic developing system shown in FIG. 3 by use of the AR system according to the following order: Water (825 ml)—Solution (A) (80 ml)—Solution (B-1) (40 ml)—Solution (C) (30 ml)—Solution (D) (25 ml), followed by complete mixing thereof. The resulting mixture was supplemented to the developer tank 7 of the automatic processing machine by use of the bellows pump 6' through the circulation piping. Mixing time spent for the complete dissolution within the mixing device 11 was measured to be 3 min. and 3 sec.

Next, the same experiment as mentioned above was repeated, except that Solution (B-2) relating to the present invention as specified below was used instead of Solution (B-1).

| Solution (B-2) | |
|---|---|
| Exemplary Compound (1) | 220 g |
| 4,4'-diaminostilbenedisulfonic acid (fluorescent brightening agent) | 25 ml |
| Water | to make up 1 liter |

(The resulting mixture was adjusted to pH 7 by use of sodium hydroxide or a diluted sulfuric acid.)

However, since potassium carbonate may be formed from the above-mentioned Exemplary Compound (1) during the mixing for dissolution, the equivalent amount of potassium carbonate which had been formed thereby was removed from said Solution (A) and then Solution (A) was condensated to one half as much to be a 40 ml solution for addition. The addition amount of Solution (B-2) was 80 ml. With the rest of the conditions having been exactly the same as those of the previous experiment, the replenisher compositions were added to the same order as mentioned above, and the mixing time spent for the complete dissolution within the mixing tank was measured to be only 28 sec.

From the above-mentioned results of the experiments, according to the present replenishing process, there can be provided a replenisher composition which can completely dissolve in an extremely short period of time, with which an automatic developing apparatus can be replenished.

EXAMPLE 2

The mixing device 11 of the automatic developing system shown in FIG. 3 in Example 1 was removed, and, instead, the automatic developing system shown in FIG. 1 to be used in the replenishing process of the present invention was used to perform several cycles of replenishment as a Comparative Example in the following order: Water (196.5 ml)—Solution (A) (19 ml)—Solution (B-1) (9.5 ml)—Solution (C)(7.2 ml)—Solution (D) (6 ml)

Several cycles of replenishment were performed in exactly the same manner as that of the above-mentioned experiment except that Solution (B-2) of the present invention was used instead of Solution (B-1).

As a result, in the experiment in which Solution (B-1) was used as a Comparative Example, there was observed floating of benzyl alcohol, which is a poorly soluble alcohol, on the surface of the developing solution in the developer tank of the automatic processing apparatus, and the light-sensitive material and the developer tank were smeared.

In contrast thereto, in the process in which Solution (B-2) of the present invention was used, there was not observed any floating of benzyl alcohol in spite of the fact that the mixing device was removed, and the light-sensitive materials and the developer tank were not smeared.

Thus, it was found that the replenishing process of the present invention is quite excellent to be used in the AR system, since it does not require any mixing device, and hence the AR system may be made compact; any floating of a poorly soluble alcohol, for example, benzyl alcohol etc. will not occur; and any smear of light-sensitive materials and the developer tank will be obviated.

EXAMPLE 3

By use of the automatic processing system shown in FIG. 2 instead of the automatic processing system shown in FIG. 1, simultaneous replenishment with Solution (A) to (D) of the present invention and water were performed through the bellows pump. As a result, there was not observed any floating of benzyl alcohol and any smear of light-sensitive materials and the developer tank did not occur.

EXAMPLE 4

Experiments were performed in exactly the same manner as in Example 1 except that Exemplary Compound (1) in Replenisher Composition (B) used in Example 1 was replaced by Exemplary Compounds (2) and (4), respectively. As the result, there was obtained the same result as in Example 1.

EXAMPLE 5

Experiments were performed in the same manner as in Example 1 except that Exemplary Compound (IV-1), which was a developing agent of Replenisher Composition C in Example 1 was replaced by 4-amino-N,N-diethylaminoaniline hydrochloride of Exemplary compound (A) and p-toluenesulfonate of Examplary Compound (IV-11) respectively, to measure the time until the replenisher composition was dissolved in the mixing device. The thus obtained results are shown in Table 1.

TABLE 1

| Color Developing Agent | Dissolution order of the solutions Water→(A)→(B-1)→(C)→(D) | Dissolution order of the solutions Water→(A)→(B-2)→(C)→(D) |
|---|---|---|
| Exemplary Compound (IV-1) | 3 min. 30 sec. | 28 sec. |
| Exemplary Compound (A) | 5 min. 30 sec. | 1 min. 18 sec. |
| Exemplary Compound (IV-11) | 3 min. 27 sec. | 19 sec. |

As is clear from the above Table, when a developing agent represented by the general formula (IV) was used as the replenisher composition according to the present invention, it was found that the time required for dissolution was very short, and the effect of the present invention was further enhanced. It was also found when a p-phenylenediamine color developing agent, which further has a substituent including an oxyethylene group such as Exemplary Compound (IV-11) as a substituent for an amino group, was used, the time required for dissolution was further shortened and a more favorable effect could be obtained.

EXAMPLE 6

Solutions (B-1) and (B-2) prepared in the above-mentioned Example 1 were respectively put into a polyethylene container having a capacity of 1.2 liter, and kept at 50° C. for three months, then the quantitative analysis was performed of the benzaldehyde which have been formed and of the remaining benzyl alcohol by means of gas chromatography.

As the result, in Comparative Example (B-1), 3.5% of benzaldehyde was formed; in the case of Example (B-2) of the present invention it was observed to be merely 0.3%. From this, it will be understood that the storability of benzyl alcohol may be improved when the composition of the present invention is used.

We claim:

1. A process for replenishing a color developing solution in an automatic processing machine by using a replenisher composition comprising at least two separate solutions one of said solutions being a solution having an alkaline substance dissolved therein and another of said solutions being a solution containing an alkali-cleavable water-soluble salt of a poorly soluble alcohol.

2. The process according to claim 1 wherein the color developing solution in an automatic processing machine is replenished with the replenisher composition comprising the at least two separate solutions with substantially no mixing thereof prior to the replenishment.

3. The process according to claim 1, wherein the solution dissolving an alkaline substance has a pH of 7.5 or more.

4. The process according to claim 3, wherein the solution dissolving an alkaline substance has a pH of 9 or more.

5. The process according to claim 1, wherein the alkali-cleavable water-soluble salt of a poorly soluble alcohol is represented by the formula:

$$R—(CH_2)_n—O—X—O—M$$

wherein R represents an alkyl group having 1 to 10 carbon atoms or an aryl group; X represents group —CO—, —SO—, —$SO_2$—, —$PO_2$— or —BO—; M represents an alkali metal or an ammonium group; n is an integer of 1 to 4.

6. The process according to claim 5, wherein the alkali-cleavable water-soluble salt of a poorly soluble alcohol is represented by the following formula:

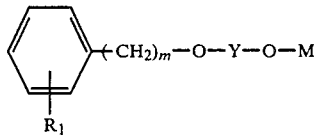

wherein $R_1$ is a hydrogen atom, an alkyl group having 1–4 carbon atoms; Y represents groups —CO— or —SO—; M represents an alkali metal atom or an ammonium group.

7. The process according to claim 1, wherein the pH value of the solution containing the alkali-cleavable water-soluble salt of a poorly soluble alcohol is maintained at 4 to 9.

8. The process according to claim 1, wherein the solution dissolving an alkaline substance and the solution to which there has been added an alkali-cleavable water-soluble salt of a poorly soluble alcohol are mixed prior to the replenishment of the color developing solution with the replenisher composition.

9. A process according to claim 1, wherein the solution dissolving an alkaline substance contains an organic phosphonic acid chelating agent or an aminopolycarboxylic acid chelating agent.

* * * * *